United States Patent [19]

Yetselev et al.

[11] Patent Number: 4,544,016

[45] Date of Patent: Oct. 1, 1985

[54] CONTINUOUS CASTING PROCESS AND APPARATUS

[76] Inventors: Zinovy N. Yetselev, prospekt Metallurgov, 73, kv. 30; Genrich I. Martynov, ulitsa Partizanskaya, 206, kv. 43, both of Kuibyshev, U.S.S.R.

[21] Appl. No.: 487,139

[22] Filed: Apr. 21, 1983

[51] Int. Cl.[4] ..... B22D 27/02

[52] U.S. Cl. ..... 164/467; 164/503

[58] Field of Search ..... 164/467, 468, 503, 504, 164/498, 499, 147.1

[56] References Cited

U.S. PATENT DOCUMENTS 3,605,865 12/1969 Getselev ..... 164/503

4,285,387 8/1981 Kindlmann et al. ..... 164/503

*Primary Examiner*—Kuang Y. Lin

*Attorney, Agent, or Firm*—Burgess, Ryan & Wayne

[57] ABSTRACT

In a continuous casting process the flow of molten metal is continuously fed into a mould to be further submitted to the action of the magnetic field generated by an electrical inductor and a stabilizing coil so that a column of molten metal is formed. The column of molten metal is then cooled to produce a continuous strand or ingot. The current supplied to the stabilizing coil has its phase lagging behind that of the current in the inductor with the phase angle between them ranging from 95° to 165°; the amplitude of current in the stabilizing coil being 0.1 to 0.4 times the current amplitude in the inductor. Apparatus for performing the above-described continuous casting process comprises a mould formed by an electromagnetic inductor and a stabilizing coil from a nonmagnetic material in the form of a triangle arranged coaxially with the inductor and having its apex oriented inside the mould. The height of the triangle in cross-section of the stabilizing coil and the greater side of the triangle are in the ratio ranging from 0.7 to 0.96.

2 Claims, 2 Drawing Figures

CONTINUOUS CASTING PROCESS AND APPARATUS

FIELD OF THE INVENTION

The present invention relates to the continuous casting of ferrous and nonferrous metals and their alloys by means of magnetic stirring, and more particularly, to a continuous casting process and apparatus.

The invention is well adapted to the production of flat, round-shaped and hollow ingots with a high-quality surface requiring no further mechanical treatment.

BACKGROUND OF THE INVENTION

Where a continuously cast strand or ingot is formed by means of a magnetic field, a circulating motion of molten metal is due to take place in the liquid portion or crater of the ingot under the action of eddy currents of the electromagnetic origin. This circulating motion of molten metal is known to enhance plasticity of the ingot. At the same time, it has been found that in certain cases, the formation of ingots in magnetic field may give rise to a heterogeneous structure of the ingot in the form of alternating bands which resemble in shape the molten crater of the ingot and which have grains of different structure. Thus, it has been proved that the emergence of the undesirable banded structure is directly associated with the intensity of metal circulation in the liquid portion of the ingot. In other words, the probability of obtaining heterogeneous structure will increase with the intensity of circulation in the molten crater of the ingot. Therefore, to prevent the appearance of the banded structure in the process of the ingot solidification, the intensity of metal circulation in the liquid portion of the ingot should be brought down to a minimum level depending on the ingot size, the alloy composition, and on the requirements to meet the ingot structure.

For example, U.S. Pat. No. 3,605,865 describes a continuous casting process in which the flow of molten metal is continuously fed into a mould and then is subjected to the action of the magnetic field created by energizing an inductor of the mould and to the action of the magnetic field of a stabilizing coil of the mould so that a column of molten metal is formed and then cooled with the resultant formation of an ingot. The process in question is performed by means of a continuous casting apparatus which comprises a mould formed by an electromagnetic inductor and a nonmagnetic stabilizing coil in the form of a triangle having its apex oriented inwardly of the mould and arranged coaxially with the inductor in direct proximity to its butt end.

The stabilizing coil is used to diminish the intensity of magnetic field along the side surface of the column of molten metal so as to permit this column to assume the shape close to that of the cast ingot. However, the stabilizing coil forms together with the inductor a two-phase electrodynamic system creating a travelling magnetic field in other words, the two-phase system comprises two conductors, namely, an inductor and a stabilizing coil, each of which carries alternating electric current differing in amplitude and phase. The electromagnetic force, directed counter to the main circuit, acts to maintain the intensity of magnetic field within the range permitting a stable casting process.

However, the stabilizing coil is ineffective to decrease the intensity of metal circulation in the molten crater of the ingot. This makes it extremely difficult to obtain a homogeneous structure of the ingot, especially in the casting of high aluminium alloys. The produced ingots have a pronounced banded structure, which adversely affects the mechanical properties of the cast product.

What is desired is a continuous casting process and apparatus in which by preventing the circulation of molten metal in the ingot crater and improving the structural arrangement of a stabilizing coil it will be possible to obtain ingots of a homogeneous structure.

SUMMARY OF THE INVENTION

It is an object of the present invention to provide a process and apparatus for the continuous casting of metal which will make it possible to produce ingots of a homogeneous structure.

Thus, the invention provides a continuous casting process which comprises feeding a molten metal into a mould, submitting the molten metal to the action of a magnetic field created by energizing an inductor of the mould and to the action of a magnetic field generated by a stabilizing coil of the mould so as to form a column of molten metal to be further cooled with the resultant formation of a continuous ingot, according to the invention, the current supplied to the stabilizing coil has its phase lagging behind that of the current in the inductor with the phase angle between them ranging from 95° to 165°, the amplitude of current in the stabilizing coil being 0.1 to 0.4 time the current amplitude in the inductor.

The invention also provides an apparatus for the continuous casting of metal, which comprises a mould formed by an electromagnetic inductor and a nonmagnetic stabilizing coil in the form of a triangle with its appex oriented inside the mould, said stabilizing coil being arranged coaxially with the inductor in direct proximity to its butt end, and a ring-shaped cooler arranged coaxially with the inductor, wherein, according to the invention, the height of the triangle in cross-section of the stabilizing coil and the greater side of the triangle are in the ratio ranging from 0.7 to 0.96, the triangle extending vertically in a plane parallel to the axis of the inductor and having its apex displaced relative to the butt end of the inductor in a manner projecting inside the mould by a distance of 0.1 to 0.5 times the height of the inductor, the apparatus also including an additional cooler for cooling the stabilizing coil, with a resistivity $\rho$ of the material of the stabilizing coil being determined by the relationship $$\rho = \frac{1}{K} \cdot f \cdot 10^{-9}\ Oh \cdot m,$$

where f is the frequency of current in the inductor, K=3 or 4.

With the continuous casting process of the invention it becomes feasible to obtain ingots of an uniform structure by substantially reducing the intensity of metal circulation in the molten crater of the ingot. This is attained by that a stabilizing coil of the mould which is fed with a current having its phase lagging behind that of the current supplied to the inductor, with the phase angle between them ranging from 95° to 165°; the amplitude of current in the stabilizing coil being 0.1 to 0.4 times the current amplitude in the inductor. If currents passing in the inductor and in the stabilizing coil are in phase or in antiphase, a travelling magnetic field will not occur with vertical component of the electromagnetic force being almost nonexistant in the surface layer of the liquid portion of the ingot. With the phase angle of 95° to 165°, a vertical component F of the electromagnetic force comes into play, directed upwardly counter to the force $F_1$ of turbulence created in the main circuit of circulation. Thus, the intensity of metal circulation is set up depending on the phase shift and the amplitude of currents. From the above, it follows that the rate of circulation of metal in the molten crater of the ingot is close to zero, which permits the banded structure of metal to be almost completely eliminated with the resultant substantial improvement of the ingot quality.

The apparatus for performing the continuous casting process of the invention makes it possible to obtain ingots of uniform structure.

BRIEF DESCRIPTION OF THE DRAWINGS

The invention will be further described, by way of example only, with reference to the accompanying drawings, wherein.

DETAILED DESCRIPTION OF THE INVENTION

According to the invention, a continuous casting process consists in that the flow of molten metal is continuously fed into a mould and then is submitted to the action of the magnetic field generated in an electrical inductor and of the magnetic field created in a stabilizing coil so as to form a column of molten metal. The column of molten metal is then cooled to produce an ingot. It should be pointed out that the stabilizing coil is fed with a current having its phase lagging behind that of the current supplied to the inductor, with the phase angle between them ranging from 95° to 165°; the amplitude of current in the stabilizing coil being 0.1 to 0.4 times the current amplitude in the inductor. The described process is suitable for the production of flat, round-shaped and hollow ingots with high-quality surfaces.

Figure 1:
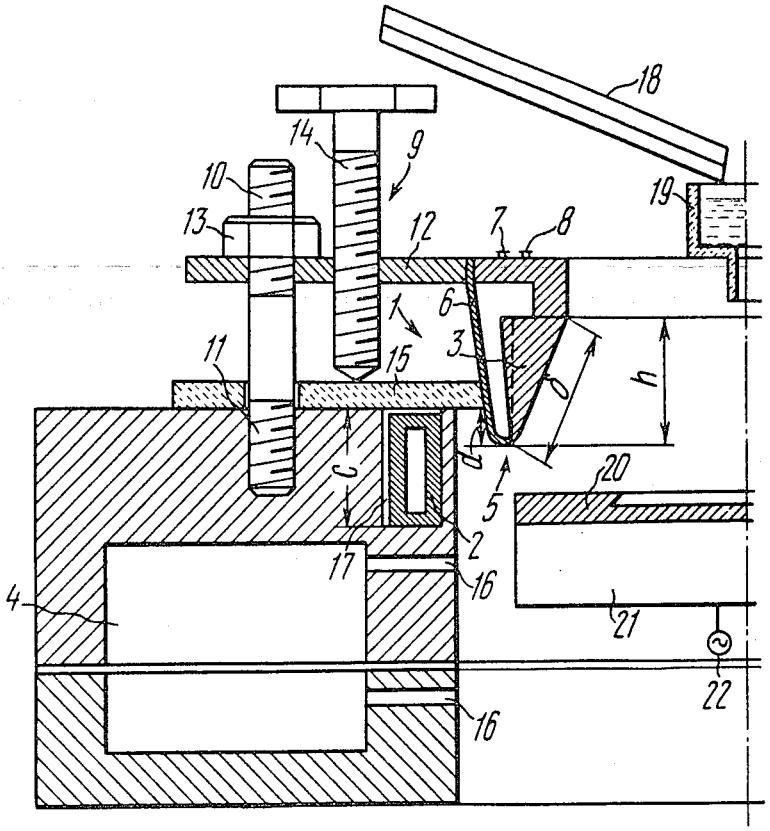
FIG. 1 is a longitudinal sectional view of a continuous casting apparatus according to the invention.

Referring now to the drawings, FIG. 1 shows a continuous casting apparatus which comprises a mould 1 formed by an electromagnetic inductor 2, a stabilizing coil 3 and a ring-shaped cooler 4. The stabilizing coil 3 is made from a nonmagnetic material in the form of a triangle having its apex oriented inside the mould 1. The stabilizing coil 3 is arranged coaxially with the inductor 2 in direct proximity to its butt end. The ratio of the triangle height "h" to the greater side δ is in the range of 0.7 to 0.96. The triangle extends vertically in a plane parallel to the axis of the inductor 2 and has its apex displaced relative to the butt end of the inductor 2 in a manner projecting inside the mould 1 by a distance "d" being 0.1 to 0.5 times the height of the inductor 2.

Resistivity $\rho$ of the material used for the stabilizing coil 3 is determined by the following relationship:

$$\rho = \frac{1}{K} \cdot f \cdot 10^{-9}\, Oh \cdot \mathrm{m},$$

where f is the frequency of current in the inductor 2, K=3 or 4.

The ring-shaped cooler 4 is located or arranged coaxially with the inductor 2. The apparatus also includes an additional cooler 5 for cooling the stabilizing coil 3. The additional cooler 5 is made in the form of a shell 6 tightly connected along the edges with the stabilizing coil 3, with the interspace therebetween being intended for the coolant circulation. Pipes 7 and 8 are provided for admitting and discharging the coolant.

An appliance 9 for fixing and displacing the stabilizing coil 3 along the axis of the mould 1 includes a dowel pin 10 in threaded engagement at 11 with the casing of the cooler 4. Secured on the pin 10 is a plate 12 which is tightened up by means of a screw nut 13. The stabilizing coil 3 is rigidly fixed on the plate 12. Fitted in the plate 12 in threaded engagement therewith is an adjusting screw 14 the end of which rests on a protective plate 15 secured to the casing of the cooler 4.

The casing of the ring-shaped cooler 4 is made up of two tightly connected parts with openings 16 provided therein for supplying a coolant onto the surface of an ingot. The casing of the cooler 4 has a bore 17 adapted to receive the electromagnetic inductor 2.

A flow of molten metal is fed to the mould 1 along a trough 18 through a funnel-shaped receptacle 19 and further onto a bottom plate 20 mounted on a platform 21 of a casting machine. The platform 21 is driven by means of an electric motor 22.

The continuous casting apparatus of the invention is operated in the following manner.

Prior to casting, the bottom plate 20 is introduced inside the inductor 2 by means of the motor 22. While a flow of coolant is fed onto the side surface of the bottom plate 20 through the opening 16 in the casing of the cooler 4, alternating voltage is applied to the inductor 2. Next, the flow of molten metal is passed along the trough 18 into the funnel-shaped receptacle 19 and thence into the mould 1 onto the bottom plate 20. A column of molten metal is then formed under the action of the magnetic field generated by the inductor 2. When the column of molten metal reaches a preset height of 40 to 50 mm, the bottom plate 20 is moved downwardly by means of the motor 22 at a speed determined by the process conditions required for a specific ingot.

At the initial stage of casting, the solidification of metal is made possible by transferring the heat of superheat to the bottom plate 20, and later as the ingot is moved downward, the coolant is delivered directly on its surface, thereby permitting the skin to be formed on the ingot in the magnetic field of the inductor 2.

The cross-sectional dimensions of the column of molten metal and, consequently, those of the ingot depend on the magnitude of current in the inductor 2. Thus the shape of the ingot depends on the shape of the inductor 2. Therefore, to avoid the danger of shape distortions during operation, the inductor 2 is safely accommodated in the bore 17.

Figure 2:
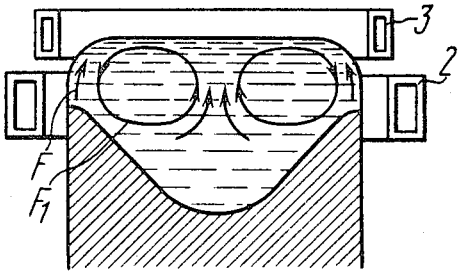
FIG. 2 represents the main circuits of metal circulation in the molten crater of the ingot and the vector of vorticity in the molten metal.

In the process of casting, eddy currents are induced in the stabilizing coil 3 by the magnetic field of the inductor 2. These currents and the current in the inductor 2 interact to produce magnetic forces F (FIG. 2) in the column of molten metal, which, directed counter to forces $F_1$ of vorticity responsible for the circulating motion of molten metal, allow for the intensity of circulation to be diminished.

As the interaction between the currents in the stabilizing coil 3 and in the inductor 2 is stepped up, the intensity of circulation is decreased with the increase of the cross-sectional size of the stabilizing coil 3. The intensity of circulation is brought down with a decrease in the h/δ ratio and with an increase in the depth of insertion of the stabilizing coil 3 into the inductor 2. Thus, increasing the cross-section of the stabilizing coil 3 and the depth of its insertion into the inductor 2 would result in a smaller phase angle between the currents of the inductor and of the stabilizing coil 3, as well as in a higher current amplitude ratio between the currents of the stabilizing coil 3 and of the inductor 2.

To ensure the optimum values for the phase angle between the currents of the stabilizing coil 3 and inductor 2, as well as for the current amplitude ratio, resistivity δ of the material used for the stabilizing coil 3 should be determined from the following relationship:

$$\rho = \frac{1}{K} \cdot f \cdot 10^{-9}\, Oh \cdot \mathrm{m},$$

where K=3 or 4.

The cross section of the stabilizing coil 3 and the depth of its insertion into the inductor 2 depend on the shape, dimensions and alloy of the ingot being cast. A required positioning of the stabilizing coil 3 is selected in accordance with a specific instance. The stabilizing coil 3 is brought in motion by means of the screw 14 and is held in place by means of the pin 10 and nut 13.

After an ingot of a preset length has been cast, the delivery of molten metal is discontinued, the bottom plate 20 is brought to a stop, and the supply of coolant is cut off. Upon complete solidification of the upper part of the ingot, the inductor 2 is deenergized.

The invention will be further described with reference to the following illustrative Examples.

EXAMPLE I

An ingot 345 mm in diameter was cast from a duralumin type of alloy at a frequency of 2,400 Hz with the rate of withdrawal ranging from 37 to 38 mm per minute. The current in the stabilizing coil 3 was regulated by means of a variable ratio matching transformer, whereas the phase angle shift between the current in the inductor 2 and in the stabilizing coil 3 was adjusted with the aid of a static phase shifter, formed, for example, by a capacitor and an inductance connected in the primary winding of a transformer supplying the stabilizing coil so that the desired phase shift is achieved between the currents in the inductor and in the stabilizing coil. It was found that with the ratio of currents in the stabilizing coil 3 and in the inductor 2 being 0.4, the circulation of metal in the liquid portion of ingot is at a minimum. With the phase angle between the currents in the stabilizing coil 3 and in the inductor 2 being 135°, the speed of metal was less than 0.5 cm/s. This mode of circulation ensured the production of ingots having a sufficiently homogeneous structure.

EXAMPLE 2

An ingot 345 mm in diameter was cast from a duralumin type of alloy at a frequency of 2,400 Hz with the rate of withdrawal ranging from 37 to 38 mm per minute. Three stabilizing coils 3 were used in succession with the h/δ ratio of 0.96, 0.86, 0.71, respectively. With d=0.25 C, all other conditions being equal, the minimum rate of circulation was achieved with the h/δ ratio of 0.71.

The ingot structure was examined on macrotemplates in transverse and longitudinal directions. It was found that the ingot structure improved with a decrease in the h/δ ratio.

What is claimed is:

1. A continuous casting process comprising the following steps:

continuous feeding of a molten metal into a mould containing an electromagnetic inductor and a non-magnetic stabilizing coil arranged coaxially with said inductor in direct proximity to its butt end;

supplying an electric current to said inductor of said mould;

supplying said stabilizing coil of said mould with an electric current with its phase lagging behind that of the current supplied to the inductor with the phase angle between them ranging from 95° to 165°, the amplitude of current in the stabilizing coil being 0.1 to 0.4 times the amplitude of current in the inductor;

submitting the molten metal to the action of an electromagnetic field created in the inductor of said mould and to the action of an electromagnetic field of the stabilizing coil of said mould so as to form a column of molten metal; and cooling said column of molten metal with the resultant formation of an ingot.

2. Apparatus for the continuous casting of metal, comprising:

a mould formed by an electromagnetic inductor and a non-magnetic stabilizing coil arranged coaxially with said inductor in direct proximity to its butt end, said stabilizing coil having in cross section the form of a triangle with its apex oriented inside said mould, the height of said triangle in cross section of said stabilizing coil and the greater side of said triangle being in the ratio ranging from 0.7 to 0.96, the triangle extending vertically in a plane parallel to the axis of said inductor and having its apex displaced relative to the butt end of said inductor in a manner projecting inside said inductor by a distance of 0.1 to 0.5 times the height of said inductor;

a ring-shaped cooler for cooling metal, arranged coaxially with said inductor;

an additional cooler for cooling said stabilizing coil, arranged coaxially therewith; and said stabilizing coil made from a material whose resistivity ρ is determined from the following relationship:

$$\rho = \frac{1}{K} \cdot f \cdot 10^{-9}\, Oh \cdot \mathrm{m},$$

where f is the frequency of current in said inductor, K=3 or 4.

* * * * *